United States Patent [19]

Reinhall

[11] 4,253,613

[45] Mar. 3, 1981

[54] METHOD AND APPARATUS FOR CONTROLLING THE EFFECT OF THE CENTRIFUGAL FORCE ON THE STOCK IN PULP DEFIBRATING APPARATUS

[76] Inventor: Rolf B. Reinhall, 834, 171st Pl. NE., Bellevue, Wash. 98008

[21] Appl. No.: 877,809

[22] Filed: Feb. 17, 1978

[51] Int. Cl.[3] ..... B02C 7/06

[52] U.S. Cl. ..... 241/16; 241/28; 241/43; 241/247; 241/261.1; 241/261.2

[58] Field of Search ..... 241/244, 245, 247, 261.1, 241/261.2, 261.3, 296, 16, 21, 2 B, 29, 43, 60, 62, 161, 162, 163, 33, 37, 261

[56] References Cited

U.S. PATENT DOCUMENTS

| | | | |
|---|---|---|---|
| 2,743,874 | 5/1956 | Asplund | 241/261.2 X |
| 3,040,997 | 6/1962 | Borden | 241/261.3 |
| 3,405,876 | 10/1968 | Yli-Paavola | 241/261.1 |

*Primary Examiner*—Mark Rosenbaum
*Attorney, Agent, or Firm*—Eric Y. Munson

[57] ABSTRACT

A method and apparatus is provided for controlling the effect of centrifugal force on pulp stock while being ground in the grinding space of a defibrating apparatus defined between a pair of grinding discs which rotate relative to one another in a fluid environment under superatmospheric pressure and corresponding elevated temperature. The grinding space includes a central portion, a first outwardly extending grinding space and a second outer grinding zone extending at an inclined angle from the first grinding zone. Pulp stock to be ground is introduced into the central portion and accelerated through the first and second grinding zones by centrifugal force generated by the rotating discs. The inclined grinding zone serves to split the centrifugal force into a vector perpendicular to the direction of flow of the pulp material and a vector aligned with the axial flow to reduce the accelerating force on the pulp grist in the direction of outward flow. By reducing the outward acceleration, the dwell time of the grist in the second grinding space is increased, resulting in optimum utilization of the entire grinding space for optimum refining efficiency.

14 Claims, 12 Drawing Figures

10
12
14
16
18
19
20
24
26
28
30
32
36
37
38
40
44
46
48
50
52
54
56
58
60
62
64
66
68
70
72
74
76
78
80
82
84
86
88
90
94
96
106
108
110
PF

Fig. 2.
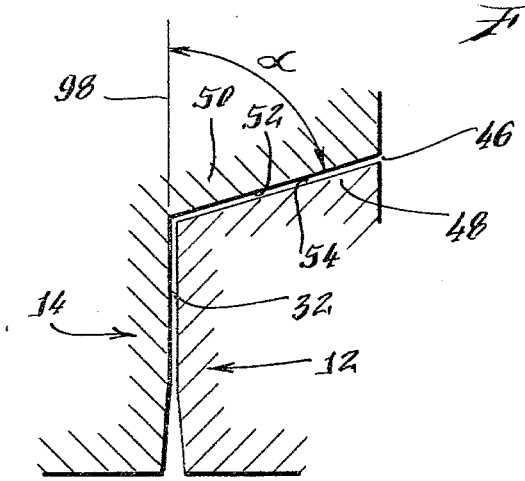
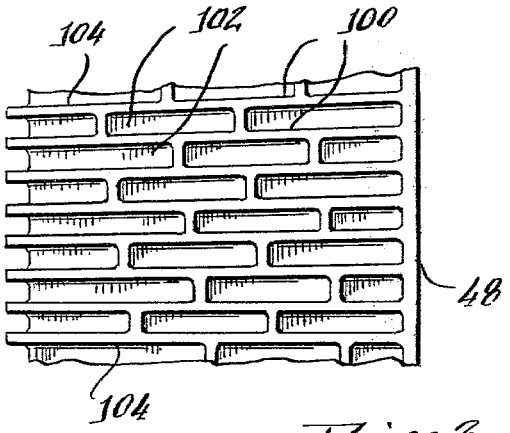
Fig. 3.
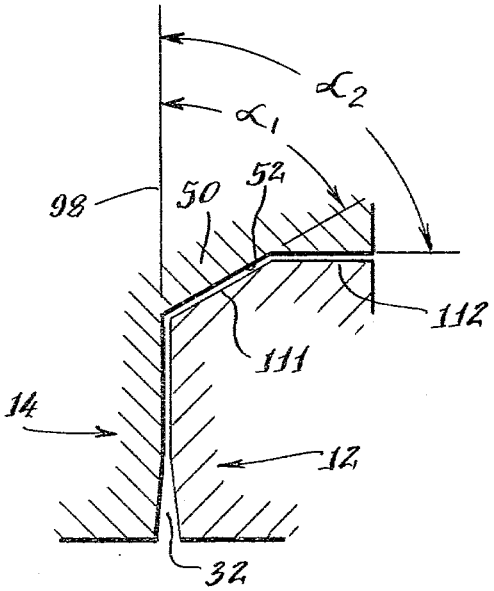
Fig. 4.
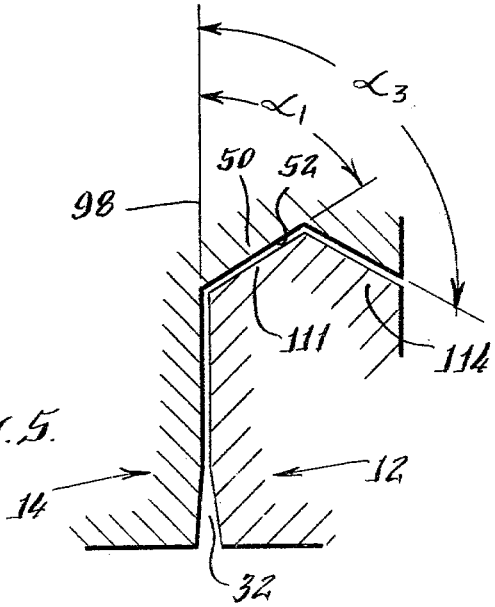
Fig. 5.

ACCELERATING

METHOD AND APPARATUS FOR CONTROLLING THE EFFECT OF THE CENTRIFUGAL FORCE ON THE STOCK IN PULP DEFIBRATING APPARATUS

BACKGROUND OF THE INVENTION

In the refining process to which the grinding discs according to the invention are particularly applicable, the pulp stock or grist is ground in a grinding space defined between a pair of discs which rotate relative to one another in an environment of fluid medium. Each disc comprises disc segments disposed annularly about the discs and is provided with ridges and grooves which shear the fibers of the grist in grinding-like fashion. The pulp material, which may consist of wood chips, bagasse, fiber pulp or similar fibrous material, is fed by a screw feeder or the like through an opening in the central portion of the stationary grinding disc into the "eye" of the grinding space and from which it is propelled by the centrifugal force generated by the rotational movement of the discs towards their periphery, where the grist is ejected with greatly accelerated force into the surrounding casing.

In order to generate the necessary centrifugal force to accelerate the stock from the inner central portion of the grinding space radially outwards and to obtain the desired degree of defibration and operating capacity in the grinding space, a high rotational speed must be imparted to the discs, such as on the order of 1500 r.p.m. to 3600 r.p.m. However, the resultant relatively high centrifugal force required to accelerate the stock from the inner disc portion, which determines the capacity of the apparatus, concommitantly subjects the grist as it progresses radially outwards to the outer disc portion to a progressively intensified centrifugal force. This intensified centrifugal force will accelerate the outward radial speed of the grist to such a degree that, unless special measures are taken to hold back the grist in the outer disc portion, the grist will be ejected prematurely from the grinding space, in only partly-treated condition, with consequent impairment of the defibration efficiency of the grinding apparatus. This problem becomes even more accentuated when steam or other vapor is generated during the grinding operation, as the result of high power input or dryness of the grist. The steam or other vapor will then flow with the grist outward through the grinding space between the discs and further accelerate the radial flow of the grist. As the centrifugal acceleration exerted on the grist is porportional to the disc diameter, as well as to the square of the r.p.m. of the disc, according to Newton's law of force and motion, the larger the diameter of the disc in the apparatus, the greater will be the problem of controlling the flow of the grist through the outer portion of the grinding space. Depending on application and capacity demand, grinding apparatuses used today normally have a disc diameter ranging between 20" and 64". Even if the larger diameter discs should be rotated at relatively slow speeds varying between 900 r.p.m. and 1800 r.p.m., they will still produce a centrifugal force of acceleration on the grist in the order of 700 g's to 2800 g's. Assume, for example, that a disc rotating at 900 r.p.m. generates a centrifugal force of 700 g's; if the r.p.m. should be increased to 1800 r.p.m., the centrifugal force will be increased by a factor of 4, thus generating an increased centrifugal force of 2800 g's.

While discs of large diameter are desirable for capacity reasons, they require large amounts of energy, which is partly wasted because of their high peripheral velocity and consequent intensified centrifugal force, which renders the peripheral portion of the grinding space substantially ineffective for defibrating purposes. In addition, the high peripheral velocity of these large discs creates a serious noise problem.

Because of increasing demand for large capacity defibration equipment with adequate refining efficiency, it has proved to be a problem in the industry to properly control the radial passage of the stock between the outer part of the opposed grinding disc segments so as to obtain maximum performance. It should be understood that, as the stock progresses through the radial passage, it migrates alternately between the grinding segments on the opposing discs, and the more work on the stock in a single pass, i.e., the longer the dwell time in the grinding space, the more efficient and economical becomes the refining process. Unless the stock flow is properly retarded, the movement of the pulp becomes too rapid, as explained herein, and the defibrating action is minimized. Hcretofore, attempts have been made to retard the passage of the grist through the grinding space by arranging the ridges and grooves in the grinding segments so that they can serve additionally as flow retarders. Such attempts are exemplified by applicant's U.S. Pat. Nos. 3,674,217, dated July 4, 1972, and 3,974,491, dated Aug. 17, 1976; and U.S. Pat. No. 3,040,997 granted to Donald A. Borden on June 26, 1962, U.S. Pat. No. 3,125,306 to E. Kollberg et al and U.S. Pat. No. 1,091,654 to Hamachek.

While these ridges and grooves serve to retard the flow, they still do not provide full utilization of the entire working area of the grinding space, since the grooves or channels between the ridges are spread out over a greater area at the periphery than at the inner portion of the grinding space. Furthermore, they do not solve the problem associated with high peripheral velocity of the presently-used large-diameter discs.

Another attempt to solve the problem of controlling the flow is exemplified by co-pending application Ser. No. 713,433, filed Aug. 11, 1976, in the name of Bo A. Ahrel, now patent No. 4,090,672. The primary object of that invention is to solve the problem created by the high pressure steam in the peripheral zone of the grinding space. In order to prevent the partly defiberized stock from being blown out from the peripheral grinding zone by the high velocity steam, Ahrel utilizes the centrifugal force to separate the steam and to open up an escape passage for the steam while retaining the steam-liberated stock between the opposing grinding surfaces.

Other examples of prior art are U.S. Pat. Nos. 1,098,325, 1,226,032, 3,684,200 and 3,845,909; and, German Patent No. 1,217,754 and Swedish Patent No. 187,564.

OBJECTS OF THE INVENTION

A principal object of the present invention is to provide a method and apparatus for controlling the effect of the centrifugal force on the pulp stock as it is passed through the grinding space defined between the grinding segments of the opposing grinding discs so as to utilize the entire working area of the grinding space without special additional retarding means while maintaining the stock in the environment of the fluid medium throughout its passage in the grinding space.

Another object is to provide a pair of grinding discs with minimized diameter defining a grinding space of increased length.

A further object is to provide a pair of grinding discs defining a grinding space for controlling the rate of flow of stock therethrough and discharge therefrom by additionally regulating the effect of the centrifugal force in the outer portion of the grinding space.

Still a further object is to prevent energy losses resulting from waste of steam and other fluid medium from the grinding space.

SUMMARY OF THE INVENTION

The invention contemplates a pair of grinding discs defining a grinding space comprising an outer zone which extends at an angle to the inner radial zone from a point spaced radially from the central portion and which comprises an inner rotating grinding surface facing a stationary outer grinding surface. The degree of the angle or incline can be calculated according to the dimension of the grinding discs and the dwell time required for optimum refining efficiency. In the inner radial zone, full utilization of the centrifugal force is maximized in order to increase the accelerating force on the stock to move it continuously away from the feed-in opening or "eye" of the grinding space. In the outer zone, on the other hand, the centrifugal force is split into a radial vector force and an axial vector force, thus reducing the accelerating force in the direction of outward flow, while prolonging the dwell time in the grinding space, with resultant utilization of each zone for optimum refining efficiency. By making the outer zone cylindrical, for example, i.e., the outer zone extending at an angle of 90° to the radial zone, the radial and axial vector forces are caused to merge into a single vector parallel to the plane of the radial zone substantially neutralizing the effect of the centrifugal force on the outward flow of the grist. On the other hand, if the angle is greater than 90°, i.e., acute, the centrifugal vector forces will have a direction opposing the outward flow. While the degree of angle is not critical to the invention, a range between 45° and 90° may be considered for most practical applications, depending on the dimension and capacity of the defibrating apparatus. However, as indicated herein, the angle of the inclined portion and its point of merger at a radially spaced distance from the central portion should be calculated with respect to the equipment used and the material to be treated, so as to maintain the pulp stock in the environment of steam or other fluid medium throughout its entire passage in the grinding space.

Additionally, if required, the invention also contemplates controlling the effect of the centrifugal force on the pulp stock in the outer inclined grinding zone by varying the degree of the angle between the ridges and grooves of the opposing disc segments relative to the generatrix of the grinding space.

The word "inclined" as used herein should be interpreted to mean any angle between obtuse and acute, including a right angle.

BRIEF DESCRIPTION OF THE DRAWINGS

FIG. 2 is a schematic view showing the grinding space defined between the stationary disc and the rotating disc.

FIG. 3 is a fractional plan view of a grinding segment in the outer grinding zone, showing a portion of the grinding surface formed with ridges and grooves.

FIGS. 4 and 5 show schematically two alternative arrangements of the grinding space.

DETAILED DESCRIPTION OF DIFFERENT EMBODIMENTS OF THE INVENTION

Figure 1:
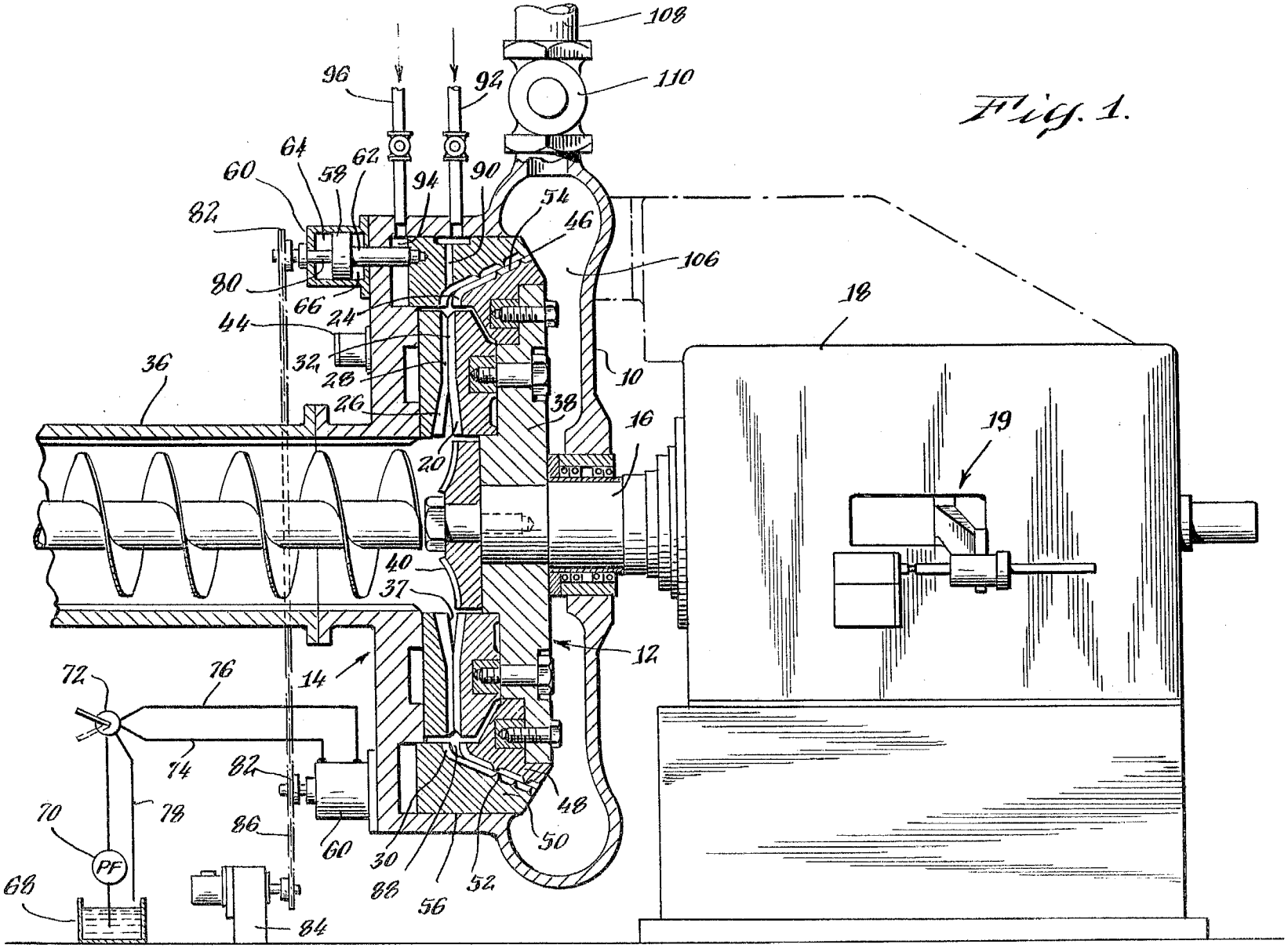
FIG. 1 is a vertical section of the portion of a defibrating apparatus embodying the invention.
Figure 9:
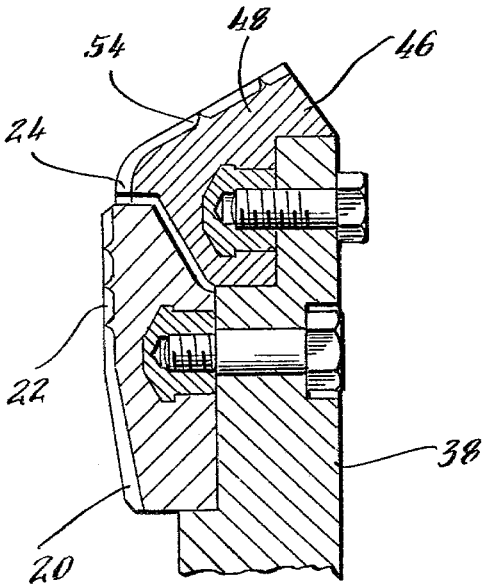
FIG. 9 is a fractional section of the rotating grinding disc according to the invention.

Referring to FIG. 1, reference numeral 10 indicates a casing or housing in which are mounted a rotating disc and a stationary disc, generally indicated by the reference numerals 12 and 14, respectively. The rotating disc is mounted on a shaft 16, which is journalled in the frame 18 of the apparatus in conventional manner, as shown, for example, in U.S. Pat. No. 3,212,721. The opposing faces of the discs are provided with conventional grinding segments portions of which are shown in FIGS. 1 and 9 as numerals 20 and 26, respectively, as shown, for example, in U.S. Pat. No. 3,974,491, and defining therebetween a grinding space 32. The grinding space comprises an inner zone or primary grinding zone which extends radially outwards substantially perpendicular to the plane of the axis of rotation. The raw material, for example, wood chips which have previously been conventionally steamed and preheated in a steaming vessel (as shown, for example, in U.S. Pat. No. 4,030,969) is fed into a central opening in the stationary disc 14 which forms a feed-out zone or "eye" 37 in the throat member 36 which is connected to the frame 10. From the "eye" 37, the steamed chips or the like are accelerated radially outwards by the centrifugal force created by the rotational movement of disc 12.

The grinding segment on the rotating disc 12 is removably mounted in conventional manner as shown in FIG. 9, on the carrier 38, which is fixed on the shaft 16, as shown, for example, in U.S. Pat. No. 3,827,644. A deflector member 40 may also be mounted on the carrier 38 to deflect the material in the "eye" 37 into the radial portion of the grinding space 32. The spacing of the stationary disc 14 in relation to the rotating disc 12 can be conventionally adjusted by means of an adjusting mechanism 44, as is also shown in the aforesaid U.S. Pat. No. 3,827,644.

The portion 18 of the apparatus frame contains the conventional journal and bearing members, as well as servo motor mechanism, generally indicated at 19, as disclosed in U.S. Pat. No. 3,212,721, which has been referred to earlier, and a detailed description thereof herein should not be necessary, since it forms no part of the invention.

According to the invention, the radial grinding zone 32 merges with an inclined outer grinding zone 46, which in the embodiments shown in FIGS. 1–3 extends at an obtuse angle to the radial or primary grinding zone, thus forming a combined grinding space having a frusto-conical profile in the example shown. The outer or secondary grinding zone is defined between the ring member 48, which is removably mounted on the segment carrier 38 of the rotating disc, as shown in FIG. 9, and ring member 50, which is mounted in the base of the stationary disc 14. Thus, the outer inclined grinding zone forms a peripherally inner rotating grinding surface, which, during its rotation, flings the pulp material into contact with the outer stationary grinding surface, which is important for achieving the objects of the invention as explained herein. The ring member 50 has an interior surface 52 which is spaced from and surrounds the exterior surface 54 of the rotating ring member 48. The ring member 50 in the stationary disc is axially adjustable in order to permit adjustment of the width of the grinding space 46 between the grinding surfaces 52 and 54. For this purpose, the ring member 50 is slidably seated in a cylindrical annular recess 56 in the stationary base and actuated by pistons 58, which are mounted to reciprocate in the cylinder 60 and arranged at intervals about the circumference of the recess 56. The pistons are connected to the ring member 50 by means of piston rods 62.

The ring member 50 can be moved towards the rotating ring member 48 by supplying hydraulic fluid to the outer portion of chamber 64 in order to narrow the space 46. Conversely, supply of fluid to the opposite end of the pistons in the chamber 66 will widen the space. The hydraulic fluid for moving the pistons 58 is pumped from the reservoir 68 through the conduits 74, 76 by means of the pump 70 and the reversing valve 72. The hydraulic fluid is returned to the container 68 through the conduit 78.

The tappets 80 are inserted into the outer wall of the piston cylinders and extend into the chamber 64 to abut the piston 58. These tappets carry a drive wheel 82 which is driven by a motor 84 by means of transmission belt 86. By means of this drive mechanism, the tappets can be axially adjusted to form a stop for the pistons, and thus secure the width of the grinding space 46.

Between the two grinding zones 32 and 46 is a widened annular space 88, which can be supplied with a cooling and/or chemical reacting fluid, for example, water, with or without selected chemicals dissolved therein, through the channels 90 in the stationary ring member 50 and pressure pipe 92. The space 94 at the rear of ring member 50 communicates with a pipe 96 for passing a pressure medium, such as water, to maintain a higher pressure in the space 94 than in the grinding space 46, so as to force a weak flow of the pressure medium into the annular recess 56 to prevent ground grist from penetrating between the slidably engaging surfaces of the ring member 59 and the recess 56.

According to the invention, the grinding space 46 extends at an angle to the vertical plane 98 of the inner grinding space 32. This angle may vary in accordance with the equipment used and the material to be refined, and should be calculated so that the centrifugal force on the pulp stock is sufficiently retarded to cause the entire area of the grinding space to be fully utilized and the pulp stock to be maintained in the environment of the fluid medium throughout its passage in the combined grinding zones. Thus, the angle can also be equated with an adjustable discharge valve for regulating the rate of discharge of defibrated pulp from the grinding housing. Experiments have shown, however, that the best results are obtained if the angle is greater than 45°, and preferably greater than 60°. However, specially good results have been achieved with angles ranging between 75° and 82°.

In the inner radial grinding zone 32, the pulp stock will be accelerated from the "eye" 37 radially outwards by the centrifugal force at a substantially uniform rate of flow, because of the retarding effect produced by the sharp "bend" in the passage where the secondary grinding zone connects with the primary radial zone. Thus, the rotational speed of the discs can be increased, with consequent enhanced defibration efficiency, despite the concommitant intensified centrifugal force. As previously explained herein, this centrifugal force is essential in order to accelerate the grist through the inner portion of the radial passage, but, unless it is adequately retarded or its effect on the grist controlled, it will cause the partly-treated grist to be blown out at the periphery of the conventional discs heretofore used. Therefore, this partial elimination or complete retardation of the effect of the centrifugal force on the pulp stock in the peripheral zone of the grinding space, where it is not needed, is a great achievement of the present invention.

For further clarification of the problem heretofore encountered, it should be explained that, while it is desirable for the discs to have a high rotational speed, not only for the purpose of accelerating the grist, but also for the purpose of creating high frictional stresses in the grinding space to achieve adequate defibration and fiber separation, the high rotational speed imparted to the discs, such as 900 r.p.m. to 1800 r.p.m., or even higher, such as 3600 r.p.m., requires a great amount of energy, which is converted into high temperature heat in the grinding space. Therefore, water or other cooling fluids must be added to the grinding process to prevent carbonization or heat degradation of the grist. These cooling fluids are at least partly vaporized in the grinding space, with consequent expansion and resultant high pressure, which augments the centrifugal acceleration of the grist as the steam or other vapor is blown out through the grinding space at the periphery of the conventional grinding discs. While the defibrating process or the refining process is usually carried out in an environment of steam or other fluid medium, a large amount of steam or other fluid medium is thus wasted, with consequent large energy losses. These energy losses are avoided to a great extent by the present invention.

After having been subjected to the initial defibration in the primary or radial zone under the counter pressure by the braked centrifugal force, the grist enters the outer or secondary grinding zone 46, and the accelerating force on the grist becomes substantially reduced. Thus, the centrifugal force, which increases in proportion to the radial length of the grinding space, is compensated for, with consequent retarded rate of flow and prolonged dwell time for the grist in the grinding space. The centrifugal force on the grist has a vector perpendicular to the generatrix of the space 46, which force is exerted against the stationary grinding disc 14 or its adjustable ring member 50, and the force vector in the direction of flow constitutes only a relatively small portion of the centrifugal force.

Due to its slope relative to the plane 98 of the radial grinding space, very small adjustments of the width of the grinding space 46 can be made in proportion to relatively large displacements of the ring member 50.

FIG. 3 shows a portion of the grinding surface 54 of a disc segment in the outer grinding zone which is formed with ridges or dams 100, with intervening grooves or channels 102, the length of which channels may be interrupted by transverse ridges 104, which form mechanical stops for the flow of grist. The grinding surface 52 of the stationary segment is provided with similar ridges and grooves. Thus, the movement of the grist, while being forced outwards in the inclined grinding space, will alternately be arrested by the transverse ridges 104 on one of the grinding segments and rolled into the grooves of the opposing segment, so that the grist will migrate alternately between the two grinding segments and flow along a sinuous path towards the open end of the grinding space and into the interior 106 of the housing 10, thus minimizing separation of steam or other fluid medium from the grist.

The segments in the grinding space 32 may be provided with similar ridges and grooves.

The raw material which is fed by the screw feeder 34 into the "eye" of the grinding space is usually preheated or pre-steamed and has a dry content of about 15%–20% or higher. As previously explained herein, water or other cooling fluid is supplied through the conduits 92, which can also be used for adding chemicals, such as oxydizing or reducing agents, as well as for adjusting the Ph value of the grist and adding lignin-dissolving compounds. Due to the high peripheral velocity in this area, the space can with advantage also be utilized for mixing gaseous compounds with the treated pulp, e.g., $SO_2$, oxygen, ozone or similar gases which may be used in the refining process.

The completely defibered pulp stock is discharged into the interior 106 of the housing, where it is subjected to a whirling motion and discharged through the conduit 108. The rate of discharge is controlled by means of the discharge valve 110, so that a predetermined pressure will be maintained within the grinding disc housing. In the so-called thermo-mechanical pulping process, the temperature in the grinding space should range between 100° C. and 160° C., depending on the dwell time in the grinding space, and the addition of water should be calculated so as to produce a corresponding steam pressure in the grinding space, which may not be the same as the pressure in the surrounding disc housing.

The high speed of rotation of grinding segments 20, 22 and 24, because of their weight, generates also a substantial centrifugal moment in a direction outwardly from the rotating disc and produces torque on the carrier disc 38, tending to deflect or bend the latter at its periphery to the right in FIG. 1. Such torque tends to create a non-uniform spacing between the grinding segments, causing the grinding space to vary in width along the inclined passage. By providing the carrier member 38 with an annular member 48, which extends axially from the carrier disc away from the grinding segments, the torque can be counterbalanced to maintain a uniform spacing between the setments. For this purpose, the center of gravity of the rotating disc segment 46 is located in a central plane through the carrier disc 38 as shown in FIG. 9.

As shown in FIG. 4, the outer grinding zone is divided into two portions: the inner portion 111 sloping relative to the plane 98 at an acute angle $\alpha_1$; and an outer portion 112, which is cylindrical and, consequently, forms an angle $\alpha_2$ of 90° relative to the plane 98. Preferably, the angle of the inner portion 111 should be greater than 45°. In the outer portion 112, the centrifugal force is neutralized by the stationary disc, and the rate of flow is controlled entirely by the inner portion 111.

In the embodiment shown in FIG. 5, the outer grinding zone 46 comprises a portion 111 and a portion 114 whose slope angles $\alpha_1$ and $\alpha_2$ are respectively acute and obtuse. Thus, the acute angle $\alpha_1$ is preferably less than 90° and preferably greater than 45°, and the obtuse angle $\alpha_2$ is preferably greater than 90°, so that the grist will be forced out by the pressure built up in the inner zones against the tangential vector of the centrifugal force.

Figure 6A:
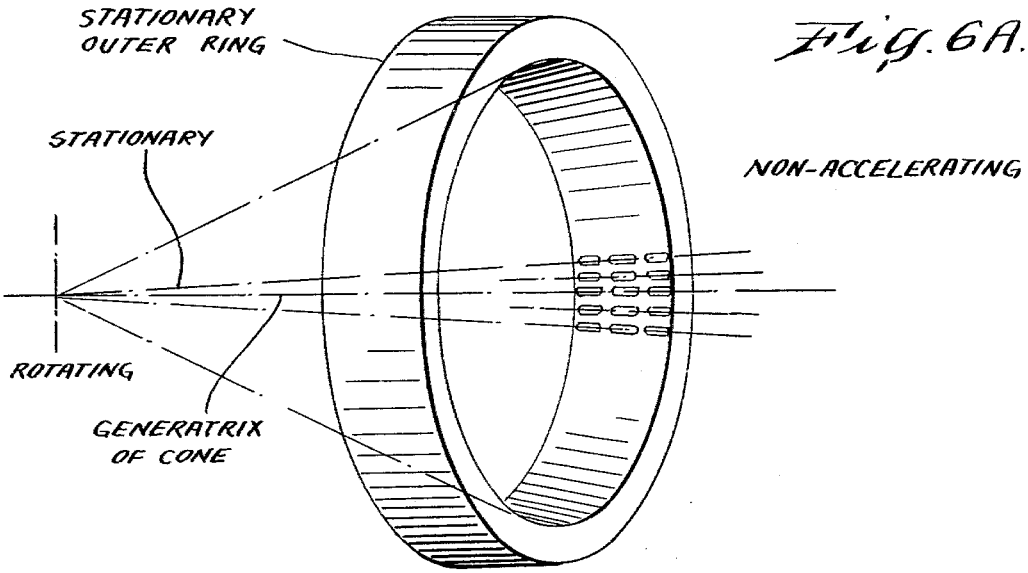
FIG. 6A is a schematic view illustrating an outer frusto-conical grinding space in non-accelerating flow mode with the outer stationary grinding disc shown in perspective.
Figure 6B:
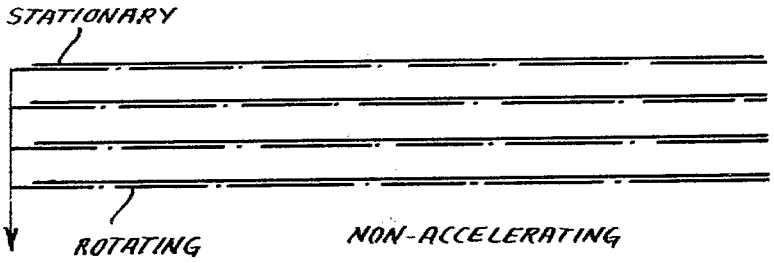
FIG. 6B is a vector diagram thereof showing the action of the ridges and grooves on the pulp stock.
Figure 7A:
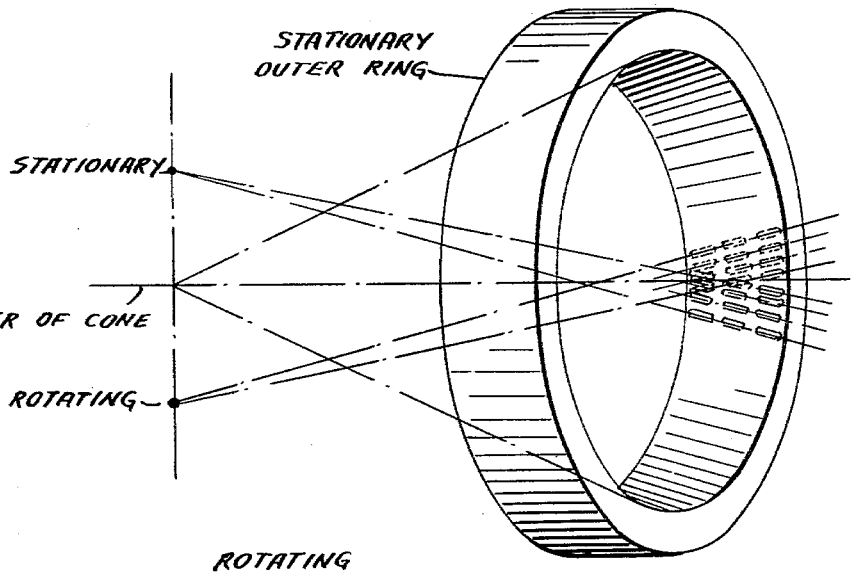
FIG. 7A is a view similar to FIG. 6A, showing the outer grinding space in a flow-accelerating mode.
Figure 7B:
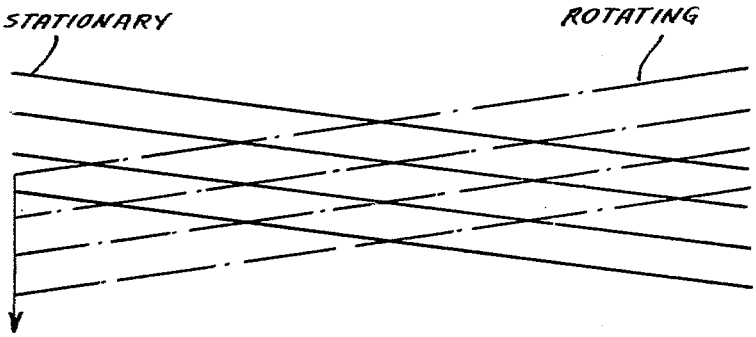
FIG. 7B is a vector diagram thereof.
Figure 8A:
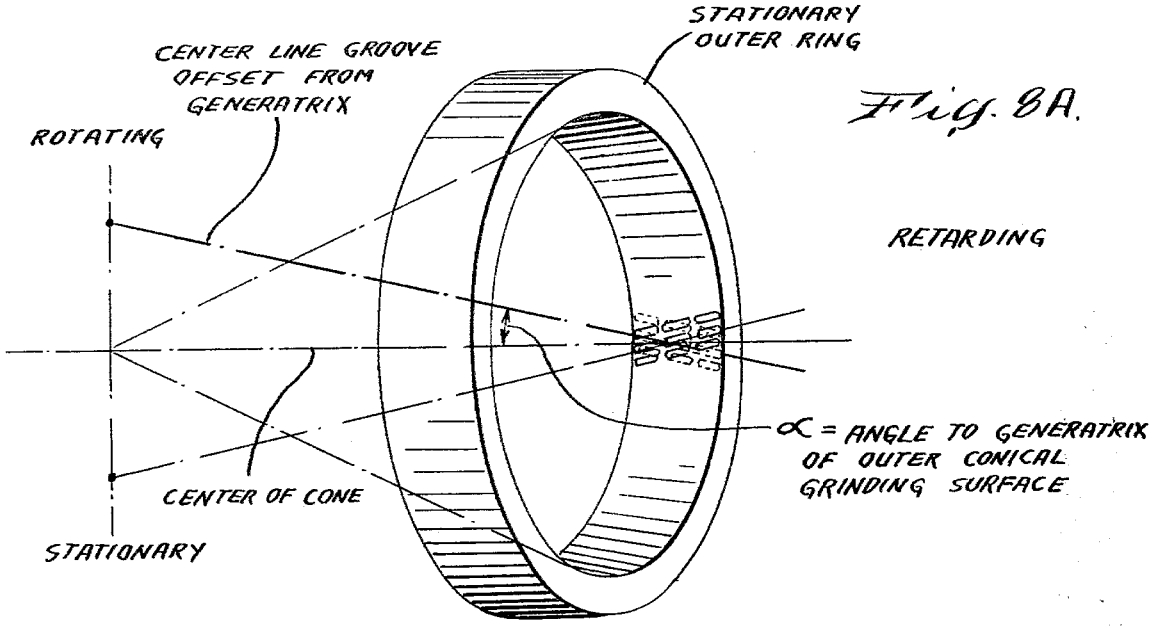
FIG. 8A shows the conical grinding space in a flow-retarding mode.
Figure 8B:
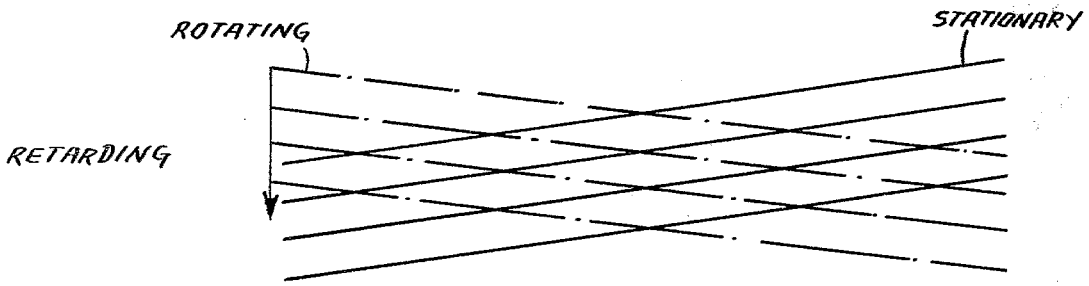
FIG. 8B is a vector diagram thereof.

FIGS. 6A, 6B, 7A, 7B, 8A and 8B illustrate how the effect of the centrifugal force can additionally be controlled in the outer inclined portion of the grinding space. In FIGS. 6B, 7B and 8B, the centerline of the grooves in the stationary disc is drawn in solid lines, whereas the centerline of the grooves in the rotating disc is drawn in broken lines. The arrows at the lefthand side of the drawing indicate the direction of rotation.

In FIGS. 7A and 7B, the centerline of the grooves in the two opposing segments is in alignment with the generatrix of the grinding surface, thus, it acts neither to accelerate the flow nor to retard it.

FIGS. 7A and 7B illustrate how the angle of the ridges and grooves of the opposing grinding segments can be changed relative to the generatrix of the grinding space to accelerate the flow of grist in the frusto-conical grinding space towards the discharge opening and, thus, augment the effect of the centrifugal force.

FIGS. 8A and 8B illustrate the angle between the ridges and grooves of the opposing grinding segments relative to the generatrix of the frusto-conical grinding space in a flow-retarding mode.

Disc segments selected to produce the desired flow rate can be exchanged in the defibrating apparatus fairly rapidly in the same conventional manner as worn or damaged segments are replaced.

The purpose of grinding is to fiberize the raw material with minimum damage to the fibers and to develop the quality required for the specific end use. In connection therewith, it is of great importance to have the highest possible capacity, with the lowest possible energy consumption, to minimize production costs. There are many variables in the pulping process which call for fairly rapid adjustments during passage of the pulp stock through the grinding space. Among these variables are: different species of raw material; moisture content; length of the grinding zone; the rotational speed of the grinding discs; and the efficiency of the energy transfer. Most of these variables can efficiently be met by regulating the load or grinding pressure in the grinding space.

The system according to the invention provides highly efficient and flexible means of influencing the grinding result. Thus, by dividing the grinding space into two zones, namely, a radial zone where the grinding pressure can be increased under the effect of the centrifugal force generated by the rotational movement of the discs; and an inclined zone merging with the radial zone at a calculated radial distance from the central inner portion thereof, the grinding pressure can be decreased if desired, and the rate of flow of the grist regulated by varying the effect of the centrifugal force in the inclined zone. The angle of inclination can easily be calculated so as to ensure full utilization of the entire length of the grinding space while maintaining the grist in the fluid medium throughout the passage.

The invention adds flexibility to the manner of control by varying the angle between the ridges and grooves of the opposing grinding segments in the outer zone relative to the generatrix of the grinding space.

Thus, if it should develop during the pulping process that the angle of the inclined outer grinding space should not respond properly to the raw material treated, disc dimension used, power input or other variables, corrections may be made by changing the disc segments in the outer grinding zone, without replacing the entire rotating disc. In addition, the invention provides for minute adjustments of the width of the inclined grinding space during the pulping process without shutdown of the operation.

Defibration equipment to which the invention is applicable usually include instruments which give full information of the state of the pulping process, such as load and grinding pressure, rate of stock consumption, need of cooling water and other variables influencing the grinding process, so that fairly rapid adjustments can be made to meet these variables by use of the invention. These instruments are conventional in the art and form no part of the invention and should, therefore, not require a special description.

It should, of course, be understood that, while the inner disc has been described as the rotating disc, and the outer disc as the stationary disc, the outer disc may rotate, and the inner disc be stationary, or both can rotate relative to one another, without departing from the invention. To make such modifications would be obvious to anyone skilled in the art.

I claim:

1. In the method of refining pulp stock in which the pulp material is ground in a grinding space defined between a pair of grinding discs having ridges and grooves providing opposing grinding surfaces, which discs rotate relative to one another in an environment of a fluid medium under superatmospheric pressure and correspondingly elevated temperature in a housing, and in which grinding space the pulp material is accelerated from a central portion outwards towards a peripheral portion by the centrifugal force generated by the relative rotational movement of the discs, the improvement for controlling the effect of the centrifugal force on the pulp, comprising: axially inclining the peripheral portion of the grinding space to form an inner passage extending from said central portion and an outer axially inclined passage having a peripherally outer stationary grinding surface facing an inner rotating grinding surface, the length of said inner passage and the angle of inclination of said outer passage being calculated in accordance with the pulp material and the equipment used to maximize the effect of the centrifugal force exerted on the pulp material in the direction of flow through said inner passage and split the centrifugal force exerted on the pulp material in said outer passage into two force vectors, the vector perpendicular to the direction of flow being greater than the vector in the axial direction of flow, to thereby reduce the outwardly accelerating force.

2. Method according to claim 1, in which the effect of the centrifugal force is additionally controlled by arranging the ridges and intervening grooves of the opposing grinding surfaces in the inclined portion of the grinding space so as to regulate the rate of flow of pulp stock in response to variables of the pulping process.

3. The method according to claim 1, comprising further inclining a portion of the inclined grinding space at an angle thereto to generate a force vector substantially neutralizing the effect of the centrifugal force in said further inclined portion.

4. The method according to claim 1, comprising further inclining a portion of the inclined grinding space to generate a centrifugal force vector opposing the direction of flow of pulp stock in said further inclined portion.

5. The method according to claim 2, in which the effect of the centrifugal force is additionally controlled by varying the angle between the ridges and grooves of the opposing grinding discs relative to a generatrix of the inclined portion of the grinding space to regulate the rate of flow of the pulp stock therethrough.

6. The method according to claim 1, in which the inclined passage of the grinding space extends at an angle of at least 45° to the radial portion of the grinding space.

7. The method according to claim 1, in which the inclined passage of the grinding space extends at an angle to the radial portion ranging between 45° and 90°.

8. In a pulp defibrating apparatus in which the pulp stock is ground in a grinding space defined between a pair of grinding discs having ridges and grooves providing opposing grinding surfaces, which discs rotate relative to one another in an environment of a fluid medium under superatmospheric pressure and correspondingly elevated temperature in a housing, and in which grinding space the pulp material is accelerated from a central portion outwards and towards a peripheral portion by the centrifugal force generated by the relative rotational movement of the discs; the improvement for controlling the effect of the centrifugal force on the pulp stock in the grinding space, comprising:

(a) an inner portion of said grinding space extending peripherally outward from said central portion;

(b) an axially inclined portion extending from the peripherally outward end of said inner portion forming a peripherally inner inclined rotating grinding surface facing an outer stationary grinding surface;

(c) the length of said inner portion and the angle of said inclined portion relative to said inner portion being calculated in accordance with the pulp material to be ground and the equipment used to maximize the effect of the centrifugal force exerted in the direction of flow through said inner portion and split the centrifugal force exerted on the pulp material in said outer portion into two vector forces, the vector perpendicular to the direction of flow being greater than the vector in the axial direction of flow, to thereby reduce the outwardly accelerating force.

9. The improvement according to claim 8, in which said inclined portion comprises grinding surfaces in which the opposing ridges and grooves are arranged to additionaly control the effect of the centrifugal force on the pulp stock to regulate its rate of flow through the grinding space in response to variables of the pulping process.

10. The improvement according to claim 9, in which the ridges and grooves of the opposing discs in the inclined portion of the grinding space are disposed at an angle relative to a generatrix of the inclined portion.

11. The improvement according to claim 8, in which the inclined portion of the grinding space extends at an angle of at least 45° to the inner portion.

12. The improvement according to claim 8, in which the inclined portion extends at an angle to the inner portion, ranging between 45° and 90°.

13. The improvement according to claim 8, in which the inclined portion extends at an angle to the inner portion effective to substantially neutralize the effect of the centrifugal force in the inclined portion.

14. The improvement according to claim 8, in which the center of gravity of the rotating discs is located in the central plane through a carrier disc supporting the inner grinding surface of the inclined grinding space.

* * * * *